United States Patent [19]

Gunnewig

[11] 4,392,845

[45] Jul. 12, 1983

[54] DISCHARGE NOZZLE FOR CENTRIFUGAL SEPARATOR DRUMS

[75] Inventor: Hubert Gunnewig, Oelde, Fed. Rep. of Germany

[73] Assignee: Westfalia Separator AG, Oelde, Fed. Rep. of Germany

[21] Appl. No.: 324,920

[22] Filed: Nov. 25, 1981

[30] Foreign Application Priority Data

Feb. 3, 1981 [DE] Fed. Rep. of Germany ..... 3103531

[51] Int. Cl.[3] ..... B04B 1/10

[52] U.S. Cl. ..... 494/1; 494/4; 494/56

[58] Field of Search ..... 494/38, 40, 56, 1, 4; 210/360.1, 369, 781

[56] References Cited

U.S. PATENT DOCUMENTS

| | | | |
|---|---|---|---|
| 2,695,748 | 11/1954 | Millard | 494/38 |
| 3,075,696 | 1/1963 | Fitzsimmons | 494/56 |
| 4,149,668 | 4/1979 | Zurbruggen | 494/56 |
| 4,284,233 | 8/1981 | Kulker | 494/38 |

*Primary Examiner*—Robert W. Jenkins

*Attorney, Agent, or Firm*—Sprung, Horn, Kramer & Woods

[57] ABSTRACT

Discharge nozzles are provided in centrifugal separator drums for the continuous discharge of the concentrate separated in the drum, and are inserted into the drum wall from the outside for the sake of ease of installation and cleaning. To enable the discharge orifice to aim itself correctly tangential to the drum circumference during operation and against the direction of rotation of the drum, there is provided opposite a locking projection on the discharge nozzle, an additional, excentrically disposed projection. The center of gravity of the rotatable discharge nozzle lies in this projection, so that, under the action of centrifugal force when the drum is rotating, the center of gravity of the discharge nozzle will set itself, even if incorrectly aligned at installation, on an axis that is radial to the drum axis. The discharge orifice is aimed opposite to the direction of drum rotation at an angle of 90° to the gravity axis.

1 Claim, 2 Drawing Figures

DISCHARGE NOZZLE FOR CENTRIFUGAL SEPARATOR DRUMS

BACKGROUND OF THE INVENTION

The invention relates to a discharge nozzle for centrifugal separators in which concentrate is continuously discharged from the peripheral portion of the separating chamber, the discharge nozzle being installed in the outer periphery of the drum on a smaller diameter on the drum than the outer peripheral portion of the separating chamber. The discharge nozzle is mounted rotatably in the drum periphery and sealed by a sealing ring and has an inlet orifice and a discharge orifice plus a locking projection which engages a corresponding recess in the drum periphery so as to hold the discharge nozzle in place.

A discharge nozzle of this kind is known, for example, from U.S. Pat. No. 2,695,748, according to which nozzles are disposed at equal intervals on the circumference of the centrifugal separator and can be disposed either at the periphery of the drum or on a smaller diameter on the drum than the peripheral portion of the separating chamber. To facilitate the replacement of worn nozzles or the cleaning of the discharge orifices in the nozzle, it is common practice to fasten the nozzles externally and removably in the drum wall, corresponding installation openings being provided for this purpose in the separator casing at the level of the nozzles in the drum wall. The nozzles have to be aimed when they are installed so that the jet will emerge from the nozzles tangentially to the drum diameter and against the direction of rotation of the drum.

If the nozzle jet deviates from the tangential direction, in the case of outwardly aimed nozzles a greater amount of power is required and hence the motor may become overloaded, and in the case of inwardly aimed nozzles the drum may be damaged and thus safety of operation may be impaired.

In the known centrifugal separators, the aim of the nozzles is determined by the operator when they are installed. Since the nozzles are often disposed on the bottom of the drum, where the operator has difficulty in seeing them, the aim of the nozzles is often faulty, with the disadvantages described above.

Tangentially disposed nozzles are known, as represented, for example, in German Pat. No. 829,880, where they are precisely aligned in the drum wall, but they have the disadvantage of making the drum more costly to produce, and the nozzles themselves are harder to clean and hence the danger of clogging is increased.

For these reasons, in present-day construction, nozzle drums are provided almost exclusively with nozzles which are inserted axially.

SUMMARY OF THE INVENTION

It is the object of the invention to design nozzles of the kind mentioned above for axial installation in centrifugal separators so as to assure precise aiming.

This object is achieved by the fact that opposite the locking projection an additional, eccentrically disposed projection is provided on the discharge nozzle for the purpose of restricting the movement of the discharge nozzle in relation to the drum wall; the center of gravity of the discharge nozzle lies in this projection, so that under the effect of centrifugal force when the drum is revolving, the center of gravity locates itself on a center-of-gravity axis extending from the drum axis and the discharge orifice of the discharge nozzle is aimed against the direction of drum rotation at 90° to the center-of-gravity axis.

Due to the fact that, when the drum is rotating, the center of gravity of the discharge nozzle is disposed on a center-of-gravity axis that is radial to the drum axis, and to the fact that the discharge orifice in the nozzle is aimed at 90° from the center-of-gravity axis, the discharge nozzle that is rotatably disposed in the drum wall will automatically swing to the correct position, even if it was misaligned when it was installed in the drum wall. This also makes possible a quicker and easier replacement of the nozzle, combined with reliable aiming of same.

BRIEF DESCRIPTION OF THE DRAWINGS

An embodiment of the invention will be further explained hereinbelow in conjunction with the drawing, wherein.

DETAILED DESCRIPTION OF THE INVENTION

Figure 1:
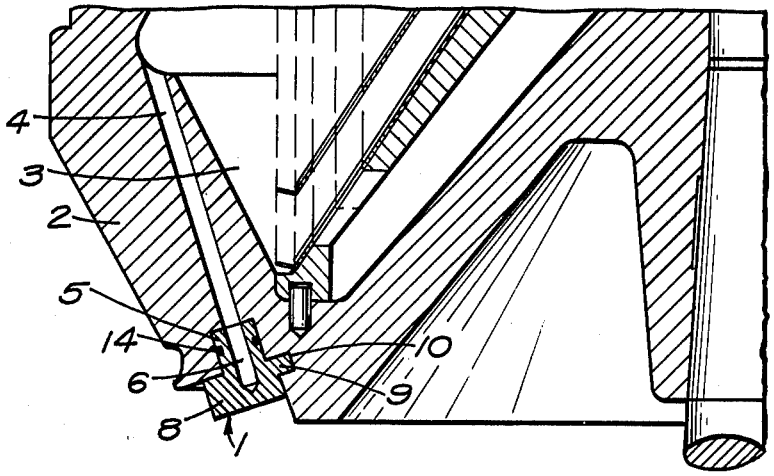
FIG. 1 is a vertical cross section of a discharge nozzle disposed in the wall of the drum of a centrifugal separator.
Figure 2:
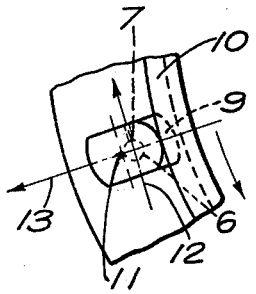
FIG. 2 is a top view of the discharge nozzle disposed in the drum wall.

The discharge nozzle 1 represented in FIGS. 1 and 2 of the drawing is disposed in the wall 2 of a centrifugal separator drum, with the concentrate that settles in the separating chamber 3 being carried out from the peripheral part of the separating chamber through passages 4, with the nozzle disposed at a smaller drum diameter than the diameter of the peripheral part. Normally, a plurality of discharge nozzles are arranged at equal intervals on the circumference of the drum.

The discharge nozzle 1 consists of the nozzle body 5 having an inlet orifice 6, a calibrated discharge orifice 7 connected with the inlet orifice, a projection 8 to restrict the movement of the discharge nozzle in relation to the drum wall, and a projection 9 which engages a corresponding recess 10 in the drum wall to hold the nozzle on.

The nozzle body has a center of gravity 11 that is situated in the projection 8 outside of the central axis 12, and when the drum is rotating it will align itself radially to the drum axis under the action of centrifugal force.

The calibrated discharge orifice 7 is provided at 90° to the center-of-gravity axis 13 and faces opposite the direction of rotation of the drum, so that, when the discharge nozzle is rotatably set in the drum wall 2, the action of centrifugal force will automatically aim this orifice 7 tangentially to the drum diameter, the discharge nozzle being sealed against the drum wall by a sealing ring 14.

It will be appreciated that the instant specification and claims are set forth by way of illustration and not limitation, and that various modifications and changes may be made without departing from the spirit and scope of the present invention.

What is claimed is:

1. In a centrifugal separator drum with continuous discharge for the removal by centrifugal force of a concentrate from a peripheral portion of a separating chamber, having at least one discharge nozzle being disposed in an outer wall of the drum at a smaller drum diameter than that of the peripheral portion of the separating chamber, at least one discharge nozzle being rotatably inserted in the drum wall and sealed by a sealing ring and having an inlet orifice, a discharge orifice and a locking projection which engages a corresponding recess in the drum wall for the fastening of the discharge nozzle, the improvement wherein the discharge nozzle comprises an additional, eccentrically disposed projection opposite the locking projection for the limiting movement of the discharge nozzle in the drum wall and wherein the center of gravity of the discharge nozzle lies in this projection, whereby under the action of the centrifugal force when the drum is rotating the center of gravity establishes itself on a center-of-gravity axis extending radially from the drum axis and, wherein the discharge orifice is disposed at 90° from the center-of-gravity axis and opposite the direction of drum rotation.

* * * * *